US005609030A

United States Patent [19]

Althaus

[11] Patent Number: 5,609,030

[45] Date of Patent: Mar. 11, 1997

[54] COMBUSTION CHAMBER WITH TEMPERATURE GRADUATED COMBUSTION FLOW

[75] Inventor: Rolf Althaus, Kobe, Japan

[73] Assignee: ABB Management AG, Baden, Switzerland

[21] Appl. No.: 552,776

[22] Filed: Nov. 3, 1995

[30] Foreign Application Priority Data

Dec. 24, 1994 [DE] Germany ..... 44 46 611.0

[51] Int. Cl.[6] ..... F02C 1/00

[52] U.S. Cl. ..... 60/737; 60/39.06; 60/738; 60/743; 60/748

[58] Field of Search ..... 60/39.02, 39.37, 60/737, 738, 743, 748, 39.06

[56] References Cited

U.S. PATENT DOCUMENTS

| | | | |
|---|---|---|---|
| 2,607,191 | 8/1952 | Lee | 60/35.6 |
| 3,078,672 | 2/1963 | Meurer | 60/743 |
| 3,974,646 | 8/1976 | Markowski et al. | 60/737 |
| 4,199,934 | 4/1980 | Meyer | 60/737 |
| 4,255,122 | 3/1981 | Alpkvist et al. | 60/737 |

FOREIGN PATENT DOCUMENTS

| | | |
|---|---|---|
| 4304989A1 | 8/1994 | Germany . |
| 4-332315 | 11/1992 | Japan . |
| WO88/08927 | 11/1988 | WIPO . |

*Primary Examiner*—Charles G. Freay
*Attorney, Agent, or Firm*—Burns, Doane, Swecker & Mathis, L.L.P.

[57] ABSTRACT

In the case of a combustion chamber which is respectively arranged upstream of and downstream of a fluid-flow machine and which essentially comprises an inflow duct (5) and a downstream premixing and combustion zone (5*a*), a fuel (11) is injected into the combustion air (4) coming from the fluid-flow machine acting upstream after the combustion air (4) flows through vortex generators (200). The injection (7*a*, 7*b*) of the fuel (11) into the premixing and combustion zone (5*a*) is effected in varying direction and quantity. The hot gases from the combustion of the aforesaid mixture form a temperature-graduated front (8), the minimum temperature of which corresponds fluidically with the base of the blades to be acted upon of the fluid-flow machine (2) . arranged downstream. The fuel (11) can be assisted with assisting air (12).

11 Claims, 3 Drawing Sheets

FIG. 7
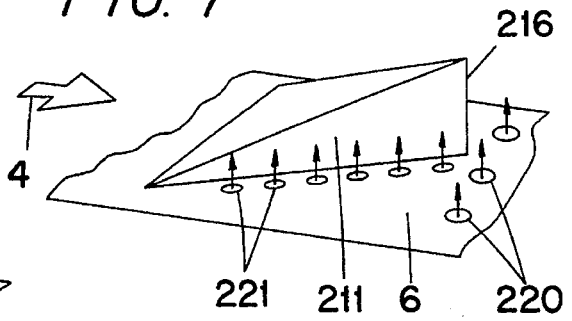
FIG. 8
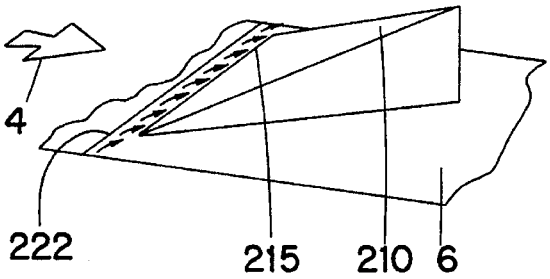
FIG. 9
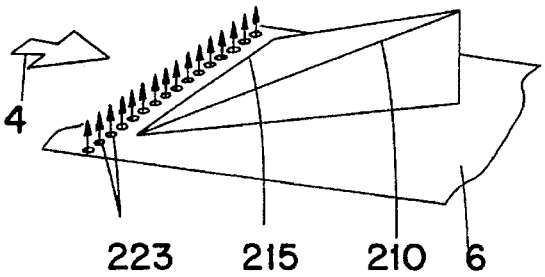
FIG. 10
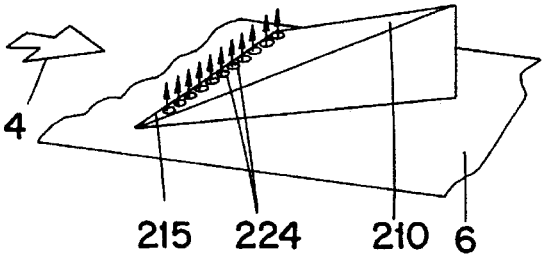
FIG. 11
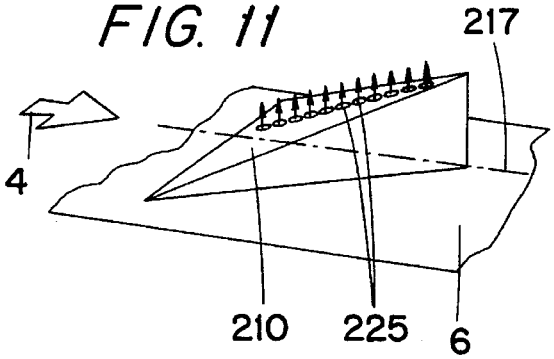
FIG. 12
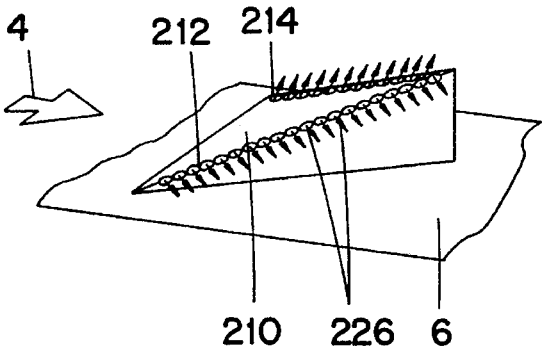
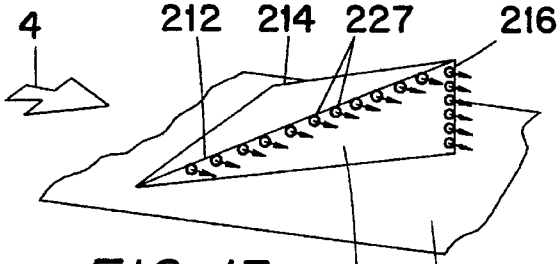
FIG. 13

COMBUSTION CHAMBER WITH TEMPERATURE GRADUATED COMBUSTION FLOW

BACKGROUND OF THE INVENTION

1. Field of the Invention

The present invention relates to a combustion chamber for ignition of a fuel with a temperature graduation flow. It also relates to a method of operating such a combustion chamber.

2. Discussion of Background

In the case of combustion chambers, in particular annular combustion chambers having a wide load range, the problem of how the service life of the blades of the turbine arranged directly downstream of the annular combustion chamber can be maximized at high temperatures of the hot gases and while maintaining low pollutant emissions repeatedly occurs. In general it can be said that the blades of the turbine are acted upon integrally with uniformly hot gases. In addition it may be noted that the blades of the turbine are subjected to even greater thermal loading in the case of an annular combustion chamber operated according to a self-ignition method. To ensure that self-ignition takes place upstream of the turbine, temperatures are aimed at which have a certain safety margin against extinction of the flame, as a result of which the blades are actually acted upon at a higher temperature than is the case in conventional combustion chambers. Here, allowance must be made for the fact that the blades have no uniform strength resistance over their radial extent, for which reason conventional blade cooling comes up against limiting factors, for certain parts of the blades ought to be cooled to a greater extent and others to a lesser extent, but up to now it has not been possible to solve this problem satisfactorily. The thermally highly loaded blade bases especially do not contribute directly to the efficiency of the fluid-flow machine, so that a lower temperature could actually prevail there without having to fear efficiency losses because of that, in which case it is assumed to be known that the average temperature of the hot gases is responsible for the resulting gain in thermal efficiency. As far as is known, no feasible solution has been disclosed up to now which is able to act upon specific parts of the blades at different temperatures without losses of efficiency and at lower pollutant emissions, in particular as far as the NOx is concerned.

SUMMARY OF THE INVENTION

Accordingly, one object of the invention is to effect a temperature graduation within the hot-gas flow in a combustion chamber of the type mentioned at the beginning.

A temperature graduation within the hot-gas flow can preferably be achieved in an annular combustion chamber by the fuel being injected via a number of fuel lances acting in the peripheral direction of the annular combustion chamber. Each of these fuel lances has a plurality of differently directed nozzles through which the fuel is introduced into the cross-section of flow of the annular combustion chamber, whereby first of all sectorial that is, location specific enrichment of the fuel mixture is obtained. Such a configuration is especially suitable for effecting sectorially different enrichment of the fuel mixture, the injected fuel being distributed primarily within the sector allocated to it, as a result of which it becomes possible to influence the temperature distribution via the fuel mixing. Thus a temperature graduation in the radial direction is achieved which represents the profile flow for the blades to be acted upon.

The vortex formation of the combustion air before the enrichment by fuel is obtained by vortex generators which are placed upstream of the fuel lances. An essential advantage of this provision is that the vortex generators are arranged sectorially, in accordance with the fuel injection, and can also produce an individual effect there.

A further essential advantage of the invention is that the temperature graduation can be specifically adapted in the radial direction. The introduction of the fuel is preferably set in such a way that the blade bases are relieved at a given average temperature of the hot gases. Although the temperature of the hot gases in the region of the blade bases is lower than the average temperature, this loss can easily be compensated for by a slightly higher temperature of the hot gases being obtained along the much larger region of the remaining blade profile. If the thermal loading in the region of the weak points is fundamentally reduced, the cooling of the blading can be reduced accordingly, which is ultimately reflected in an improvement in efficiency.

Furthermore, at predetermined turbine inlet temperature and predetermined material data, the service life of the blades is prolonged; therefore the turbine inlet temperature can accordingly be increased for the same service life, which leads to an increase in the efficiency and the output of the machine.

A further advantage of the invention is that a better transient behavior of the rotor can be achieved by a specific temperature graduation in particular in the transient load ranges, which leads to smaller clearances between the stator and the rotating parts.

Furthermore, different enrichment leads to the richer region developing a flame-stabilizing effect so that this region can readily function as a pilot stage, whereby the fitting of a combination of pilot burners and main burners can be dispensed with.

A further surprising advantage of the invention has resulted from tests: a temperature graduation achieved in such a way has a sound-absorption effect.

Advantageous and convenient further developments of the achievement of the object of the invention are defined in the further dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 6–13 show variants of the oncoming flow and the fuel feed in connection with vortex generators.

DESCRIPTION OF THE PREFERRED EMBODIMENTS

Figure 1:
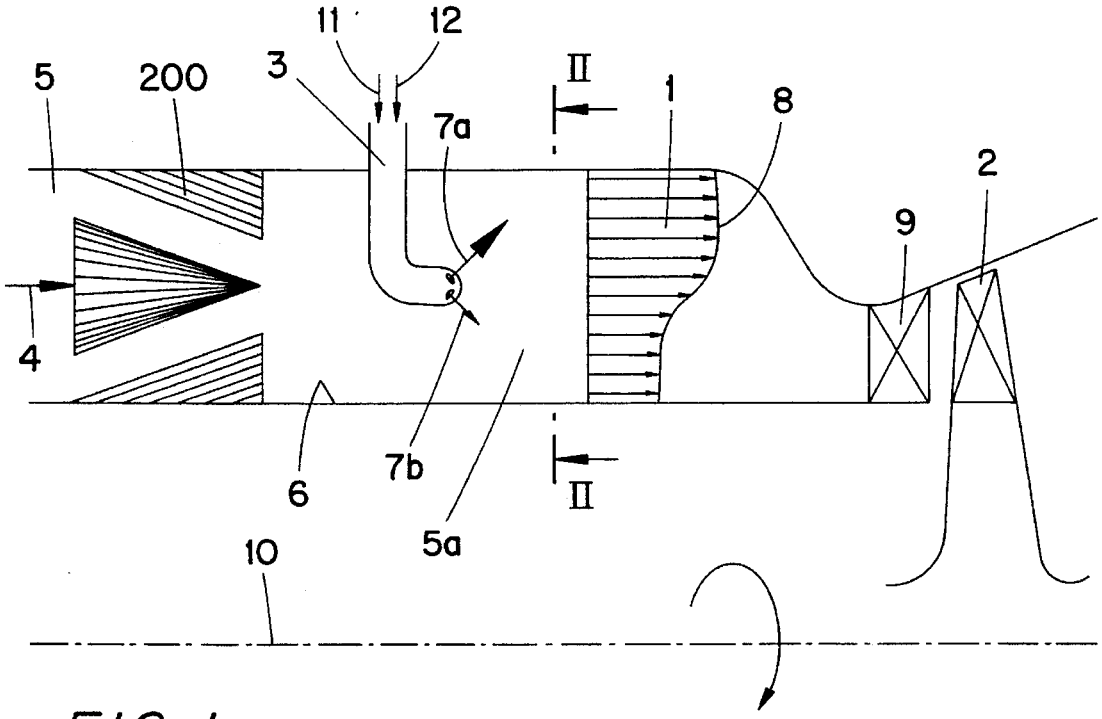
FIG. 1 shows an annular combustion chamber having temperature graduation.

Referring now to the drawings, wherein like reference numerals designate identical or corresponding parts throughout the several views, all elements not required for directly understanding the invention have been omitted, and the direction of flow of the media is indicated by arrows, in FIG. 1 an annular combustion chamber 1 is shown, as apparent from the shaft axis 10, which essentially assumes the form of a continuous, annular or quasi-annular cylinder. Such a combustion chamber can of course consist merely of a single cylinder. In addition, it is easily possible to provide a combustion chamber which consists of a number of individual axially, quasi-axially or helically running cylinders which are arranged in the peripheral direction relative to the turbine acting downstream. FIG. 1 shows only the significant part of the annular combustion chamber 1, namely the vortex formation, the fuel lance leading to a temperature graduation, and the turbine to be acted upon which is situated downstream. The main flow 4 is always a combustion air flow, the temperature and composition of which can vary considerably. If a compressor acts upstream of the annular combustion chamber 1, the main flow 4 consists of compressed air, which forms the combustion air; if on the other hand the present annular combustion chamber 1 is combined with a first combustion chamber acting upstream and a first turbine, this main flow consists of exhaust gases which are still relatively hot and whose temperature leads to self-ignition of the fuel injected there. The combustion air 4 thus flows into an inflow zone 5 which is equipped on the inside and in the inner periphery of the duct wall 6 with a number of vortex-generating elements 200, which have already been called vortex generators and will be dealt with in more detail further below. The combustion air 4 is swirled by the vortex generators 200 in such a way that recirculation areas do not occur in the wake of the said vortex generators 200 in the following premixing and combustion zone 5*a*. A plurality of fuel lances 3 are disposed in the peripheral direction of this premixing and combustion zone 5*a*, which fuel lances 3 assume the function of feeding a fuel 11 and assisting air 12. These media 11, 12 can be fed to the individual fuel lances 3, for example, by a ring main (not shown). The swirl flow initiated individually by the vortex generators 200 is in operative connection with the sectorially injected fuel 7*a*, 7*b* in such a way that a varied degree of enrichment of the partial flows of the combustion air 4 which come from the action of the vortex generators 200 results through a corresponding injectin of a different fuel quantity in the individual sectors, which varied enrichment initiates different temperature profiling during the subsequent combustion. Such a temperature graduation 8 over the cross section of flow is shown graphically and qualitatively in the figure. As can easily be inferred from this representation, this temperature-graduated hot-gas front acts upon the moving blades of a turbine 2 via corresponding guide blades 9. In accordance with the temperature graduation 8, the blade bases are subjected to less thermal loading; instead, the remaining blade area is subjected to a slightly higher temperature, so that the average hot-gas temperature decisive for the efficiency and the output is retained.

Figure 2:
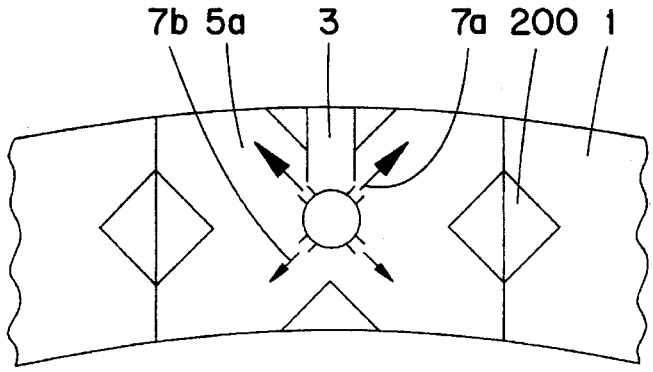
FIG. 2 shows a partial view of the annular combustion chamber, from which the range of effectiveness of an individual fuel lance is apparent.

As FIG. 2 shows, a chamber typical of an annular combustion chamber 1 is formed for each fuel lance 3 in the region of the vortex generators 200, whereby lateral vortex generators 200 can also be attached. If the combustion chamber consists of individual tubes, such a subdivision is unnecessary, since the tube then forms the chamber at the same time. Viewed thus, the fuel lance 3 is encased by vortex generators 200 in terms of oncoming flow. The sectorial fuel injection 7*a*, 7*b* is dependent upon the position of the vortex generators 200 placed upstream, in which case this injection is preferably to be directed between the individual flank surfaces of the vortex generators 200 to guarantee a temperature graduation so that the swirling arising there forms a good mixture with the corresponding fuel quantity. The fuel injection 7*a*, 7*b* can of course also be effected via a larger number of nozzles, as a function of the temperature graduation aimed at and as a function of the position of the individual vortex generators 200 inside the cross section of flow of the annular combustion chamber 1. In radial extension, this annular combustion chamber can consist of a plurality of overriding chamber rows, one of the chamber rows being designed as a pilot stage for the remaining concentrically arranged chamber rows.

The philosophy of the vortex generators will be dealt with in more detail in the following FIGS. 6–13.

Figure 3:
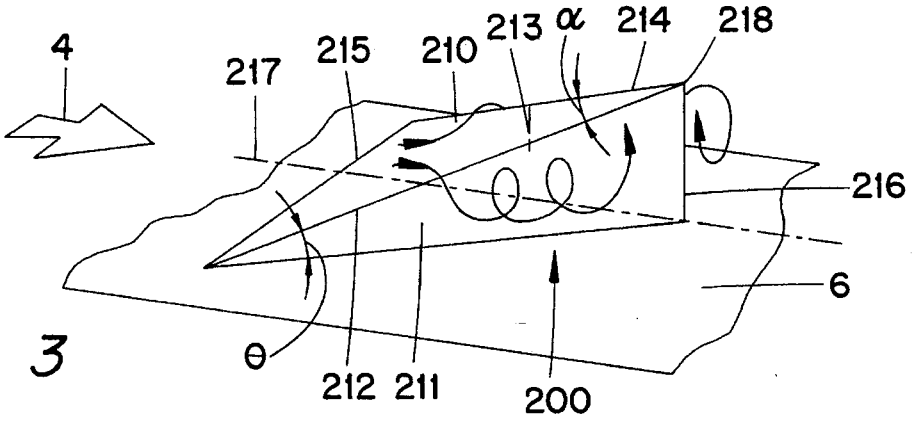
Figure 4:
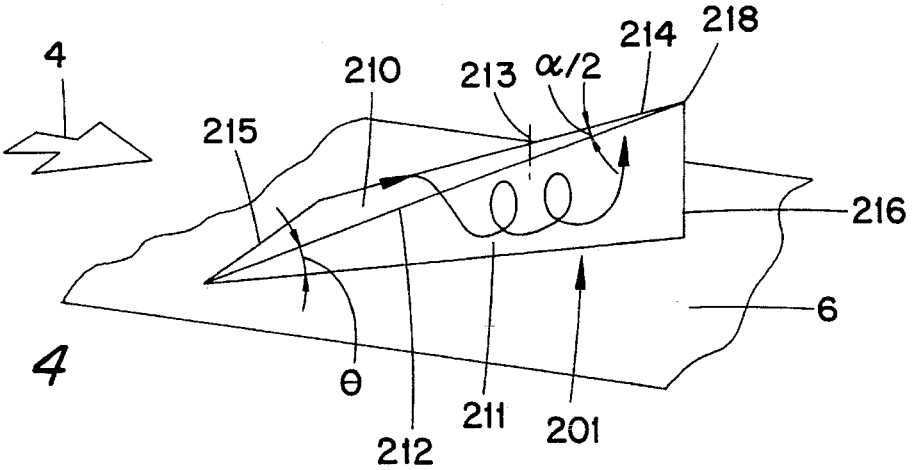
Figure 5:
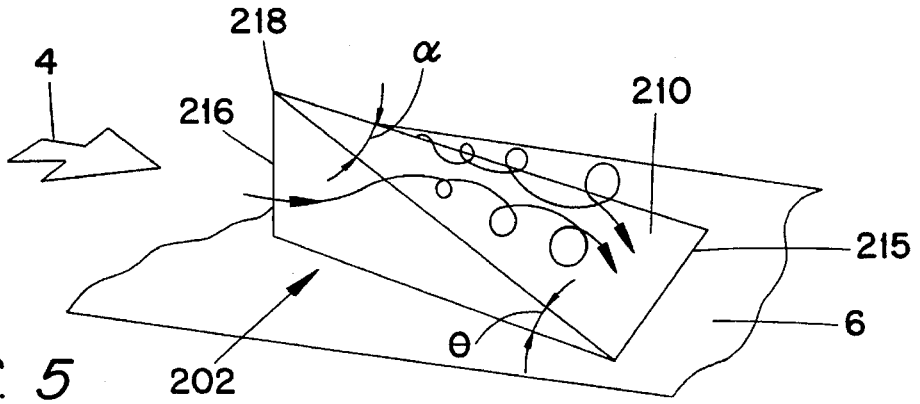

The actual inflow zone 5 is not shown in FIGS. 3, 4 and 5. However, the flow of the combustion air 4, which is also called main flow below, is shown by an arrow, whereby the direction of flow is also predetermined. According to these figures, a vortex generator 200, 201, 202 essentially comprises three triangular surfaces around which flow freely occurs. These are a top surface 210 and two side surfaces 211 and 213. In their longitudinal extent, these surfaces run at certain angles in the direction of flow. The side walls of the vortex generators 200, 201, 202, which preferably consist of right triangles, are fixed, preferably gastight, with their longitudinal sides to the duct wall 6 already discussed. They are orientated in such a way that they form a face at their narrow sides while enclosing an arrow angle $\alpha$. The face is embodied as a sharp connecting edge 216 and is perpendicular to every duct wall 6 with which the side surfaces are mounted. The two side surfaces 211, 213 enclosing the arrow angle $\alpha$ are symmetrical in form, size and orientation in FIG. 3 and they are arranged on both sides of a symmetry axis 217 which is equidirectional to the duct axis.

With a very narrow edge 215 running transversely to the duct through which flow occurs, the top surface 210 bears against the same duct wall 6 as the side surfaces 211, 213. Its longitudinally directed edges 212, 214 are flush with the longitudinally directed edges of the side surfaces 211, 213 projecting into the flow duct. The top surface 210 is oriented at a setting angle $\Theta$ to the duct wall 6, the longitudinal edges 212, 214 of which form a point 218 together with the connecting edge 216. The vortex generator 200, 201, 202 can of course also be provided with a base surface with which it is fastened to the duct wall 6 in a suitable manner. However, such a base surface is in no way connected with the mode of operation of the element.

The mode of operation of the vortex generator 200, 201, 202 is as follows: when flow occurs around the edges 212 and 214, the main flow is converted into a pair of oppositely directed vortices, as shown schematically in the figures. The vortex axes lie in the axis of the main flow. The swirl number and the location of the vortex breakdown, provided the latter is intended, are determined by corresponding selection of the setting angle $\Theta$ and the arrow angle $\alpha$. The vortex intensity and the swirl number increase as the angles increase, and the location of the swirl breakdown is displaced upstream right into the region of the vortex generator 200, 201, 202 itself. Depending on the use, these two angles $\Theta$ and $\alpha$ are predetermined by design conditions and by the process itself. These vortex generators need only be adapted in respect of length and height, as will be dealt with in detail further below with reference to FIG. 6.

In FIG. 3, the connecting edge 216 of the two side surfaces 211, 213 forms the downstream edge of the vortex generator 200. The edge 215 of the top surface 210 running transversely to the duct through which flow occurs is therefore the edge acted upon first by the duct flow.

FIG. 4 shows a so-called half "vortex generator" on the basis of a vortex generator according to FIG. 3. In the vortex generator 201 shown here, only one of the two side surfaces is provided with the arrow angle $\alpha/2$. The other side surface is straight and is orientated in the direction of flow. In contrast to the symmetrical vortex generator, only one vortex is produced here on the side having the arrow, as symbolized in the figure. Accordingly, there is no vortex-neutral field downstream of this vortex generator; on the contrary, a swirl is imposed on the flow.

FIG. 5 differs from FIG. 3 in as much as the sharp connecting edge 216 of the vortex generator 202 is here that point which is acted upon first by the duct flow. The element is accordingly turned through 180° compared to the vortex generator of FIG. 3. As apparent from the representation, the two oppositely directed vortices have changed their direction of rotation.

Figure 6:
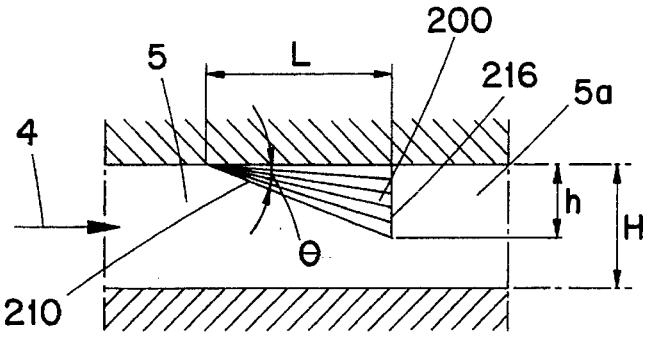

FIG. 6 shows the basic geometry of a vortex generator 200 installed in a duct 5. As a rule, the height $h_v$ of the connecting edge 216 will be coordinated with the height $H_d$ of the duct or the height of the duct part which is allocated to the vortex generator in such a way that the vortex produced already achieves such a size directly downstream of the vortex generator 200 that the full height $H_d$ of the duct is filled by it. This leads to a uniform velocity distribution in the cross section acted upon. A further criterion which can bring an influence to bear on the ratio of the two heights $h_v/H_d$ to be selected is the pressure drop which occurs when the flow passes around the vortex generator 200. It will be understood that the pressure-loss factor also increases at a greater ratio of $h_v/H_d$.

The vortex generators 200, 201, 202 are mainly used where it is a matter of mixing two flows with one another. The main flow 4, for example as hot gases, attacks the transversely directed edge 215 or the connecting edge 216 in the arrow direction. The secondary flow in the form of a gaseous and/or liquid fuel, which if need be is enriched with a portion of assisting air (of. FIG. 1), has a substantially smaller mass flow than the main flow. In the present case, this secondary flow is directed downstream of the vortex generator into the main flow, as is particularly apparent from FIG. 1.

In the example shown according to FIG. 1, the vortex generators 200 are distributed at a distance apart over the periphery of a chamber of the duct 5. The vortex generators can of course also be joined in sequence in the peripheral direction in such a way that no clear gaps are left in the duct wall 6. The vortex to be produced is ultimately decisive for the selection of the number and the arrangement of the vortex generators.

FIGS. 7–13 show further possible forms of the introduction of the fuel into the main flow 4. These variants can be combined with one another and with central fuel injection in a variety of ways, as apparent, for example, from FIG. 1.

In FIG. 7, the fuel, in addition to being injected via duct-wall bores 220 which are located downstream of the vortex generators, is also injected via wall bores 221 which are located directly next to the side surfaces 211, 213 and in their longitudinal extent in the same duct wall 6 on which the vortex generators are arranged. The introduction of the fuel through the wall bores 221 gives the vortices produced an additional impulse, which prolongs the life of the vortex generator.

In FIGS. 8 and 9, the fuel is injected via a slot 222 or via wall bores 223, both arrangements being made directly in front of the edge 215 of the top surface 210 running transversely to the duct through which flow occurs and in their longitudinal extent in the same duct wall 6 on which the vortex generators are arranged. The geometry of the wall bores 223 or of the slot 222 is selected in such a way that the fuel is fed at a certain injection angle into the main flow 4 and, as a protective film, largely screens the subsequently placed vortex generator from the hot main flow 4 by flowing around the vortex generator.

In the examples described below, the secondary flow (cf. above) is first of all directed via guides (not shown) through the duct wall 6 into the hollow interior of the vortex generators. An internal cooling means for the vortex generators is thus provided without having to provide further measures.

In FIG. 10, the fuel is injected via wall bores 224 which are located inside the top surface 210 directly behind and along the edge 215 running transversely to the duct through which flow occurs. The cooling of the vortex generator is effected here externally rather than internally. The issuing secondary flow, when flowing around the top surface 210, forms a protective layer screening the latter from the hot main flow 4.

In FIG. 11, the fuel is injected via wall bores 225 which are arranged in an echelon inside the top surface 210 along the symmetry line 217. With this variant, the duct walls 6 are protected especially effectively from the hot main flow 4, since the fuel is introduced first of all at the outer periphery of the vortices.

In FIG. 12, the fuel is injected via wall bores 226 which are located in the longitudinally directed edges 212, 214 of the top surface 210. This solution guarantees effective cooling of the vortex generators, since the fuel issues at its extremities and thus passes completely around the inner walls of the element. The secondary flow is fed here directly into the developing vortex, which leads to defined flow relationships.

In FIG. 13, the fuel is injected via wall bores 227 which are located in the side surfaces 211 and 213, on the one hand in the region of the longitudinal edges 212 and 214, and on the other hand in the region of the connecting edge 216. This variant has a similar action to that in FIG. 7 (bores 221) and in FIG. 12 (bores 226).

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A combustion chamber, which comprises:

an inflow duct followed downstream in a flow direction by a premixing zone and a combustion zone, a plurality of vortex generators mounted in the inflow duct to form individual vortices in the flow, and at least one fuel lance for injecting a fuel on a downstream side of the vortex generators into combustion air, wherein the fuel lance injects fuel with a graduated quantity profile across a radial direction of the duct and relative to the vortices generated by the vortex generators so a combusted gas flow has a temperature graduated profile over a radial direction of the combustion zone, with a minimum temperature at a radial inner side.

2. The combustion chamber as claimed in claim 1, wherein the combustion chamber is an annular combustion chamber.

3. The combustion chamber as claimed in claim 1, wherein each vortex generator has three surfaces around which flow occurs freely and which extend in the direction of flow including a top surface and two side surfaces, wherein the side surfaces are each attached by an edge to a wall segment of the inflow duct and are joined at a connecting edge to define an acute arrow angle with one another, wherein the top surface is attached to the wall segment with an edge oriented transversely to the flow direction of the inflow duct, and wherein longitudinally directed edges of the top surface are joined with longitudinally directed edges of the side surfaces projecting into the inflow duct and the top surface is oriented at a setting angle to the wall segment of the inflow duct.

4. The combustion chamber as claimed in claim 3, wherein the two side surfaces are arranged symmetrically around a symmetry axis.

5. The combustion chamber as claimed in claim 3, wherein the connecting edge of the two side surfaces and the longitudinally directed edges of the top surface meet at a point, and wherein the connecting edge lies along a radial direction of the inflow duct (5).

6. The combustion chamber as claimed in claim 5, wherein the connecting edge and the joined longitudinally directed edges of the top surface and the side surface are acutely shaped edges.

7. The combustion chamber as claimed in claim 1, wherein each vortex generator is symmetrical about a symmetry axis through the connecting edge and parallel to the duct axis, wherein the connecting edge forms the downstream edge of the vortex generator, and wherein the edge of the top surface running transversely to the inflow duct is the edge acted upon first by the flow.

8. The combustion chamber as claimed in claim 1, wherein for each vortex generator, a ratio of the height of the vortex generator measured along the connecting edge to a height of the inflow duct measured in the radial direction is selected so that a vortex is produced having a size that fills the height of the inflow duct and a full height of the duct part directly downstream of the vortex generator.

9. A method of operating a combustion chamber having an inflow duct followed downstream by a premixing zone and a combustion zone, the combustion chamber being connected upstream of a gas turbine, the method comprising the steps of:

guiding a flow of combustion air to a plurality of vortex generators in the inflow duct to produce a plurality of vortices in the flow, injecting a fuel into the combustion air on a downstream side of the vortex generators, wherein the fuel is injected with a graduated quantity distribution into the premixing and combustion zone so that combustion gases of this mixture form a temperature-graduated flow, a minimum temperature of which corresponds with a base of the gas turbine blades.

10. The method as claimed in claim 9, wherein the fuel is injected with assisting air.

11. A combustion chamber, which comprises:

an inflow duct followed downstream in a flow direction by a premixing zone and a combustion zone, a plurality of vortex generators mounted in the inflow duct to form individual vortices in the flow, each vortex generator having three surfaces around which flow occurs freely and which extend in the direction of flow, including a top surface and two side surfaces, the side surfaces each having an edge attached to a wall segment of the inflow duct, a longitudinally extending edge in the duct and being joined together at a connecting edge to define an acute arrow angle with one another, the top surface having an edge attached to the wall segment oriented transversely to the flow direction of the inflow duct, and longitudinally extending edges of the top surface are joined with the longitudinally extending edges of the side surfaces projecting into the inflow duct and the top surface being oriented at a setting angle to the wall segment of the inflow duct, at least one fuel lance for injecting a fuel on a downstream side of the vortex generators into combustion air, wherein the fuel lance injects fuel in a graduated quantity profile across a radial direction of the mixing duct.

* * * * *